United States Patent [19]

Yamaguchi

[11] 4,377,191

[45] Mar. 22, 1983

[54] COLLAPSIBLE CONTAINER

[75] Inventor: Kinichiro Yamaguchi, Tokyo, Japan

[73] Assignee: Kabushiki Kaisha Ekijibishon, Tokyo, Japan

[21] Appl. No.: 964,960

[22] Filed: Nov. 30, 1978

Related U.S. Application Data

[63] Continuation of Ser. No. 758,398, Jan. 11, 1977, abandoned.

[30] Foreign Application Priority Data

Jul. 3, 1976 [JP] Japan ..... 51-88523[U]
Nov. 1, 1976 [JP] Japan ..... 51-147766[U]

[51] Int. Cl.[3] ..... B65D 1/40
[52] U.S. Cl. ..... 150/0.5; 220/1 R
[58] Field of Search ..... 220/1 R, 83; 150/0.5

[56] References Cited

U.S. PATENT DOCUMENTS

| | | | |
|---|---|---|---|
| 1,913,652 | 6/1933 | Alexander | 220/66 |
| 1,975,265 | 10/1934 | Fulenwider | 220/66 |
| 2,880,902 | 4/1959 | Owsen | 150/0.5 X |
| 2,899,110 | 8/1959 | Parker | 220/85 B |
| 3,325,031 | 6/1967 | Singier | 150/0.5 X |
| 3,434,589 | 3/1969 | Valtri et al. | 150/0.5 X |
| 3,586,084 | 6/1971 | Redmond | 150/0.5 |
| 3,872,994 | 3/1975 | Hyde | 220/1 R |

FOREIGN PATENT DOCUMENTS

| | | | |
|---|---|---|---|
| 1429660 | 1/1966 | France | 150/0.5 |

*Primary Examiner*—Steven M. Pollard
*Attorney, Agent, or Firm*—Birch, Stewart, Kolasch & Birch

[57] ABSTRACT

A collapsible container comprising collapsible stepped walls which are formed by alternating substantially horizontal surfaces and substantially vertical surfaces.

7 Claims, 10 Drawing Figures

COLLAPSIBLE CONTAINER

This application is a continuation of copending application Ser. No. 758,398, filed on Jan. 11, 1977, now abandoned.

BACKGROUND AND SUMMARY OF THE INVENTION

The present invention relates to a container or can for foods, drinking water and the like, which is collapsible and can readily recover its shape after being used.

Recently, various kinds of foods, drinking water and the like have been processed to be contained in metal or plastic containers and cans. In accordance with the rapid increase of containers and cans, a great number of used empty cans are discarded thus producing a pollution problem as to how to deal with the voluminous use of containers. In fact, endless numbers of cans and containers are being thrown over the countryside, particularly defiling the appearance of mountains, parks and seaside areas and creating a monumental pollution and environmental problem.

One of the reasons for this environmental pollution problem is that the conventional containers cannot be collapsed by the power of an ordinary man since they are made of metal and have a sturdy structure. Another reason for such a problem is that since the volume of the prior art containers cannot be significantly reduced, even after they have been used, the vehicle transportation medium required to dispose of such containers is significant. Thus, the number of vehicles, for example, for collecting used containers is substantially the same as that for transporting filled containers and, accordingly, the collecting efficiency and disposed of used containers is very low. Although pressing machines for crushing conventional containers have been sold and used, they are expensive to purchase and difficult to economically maintain, thus they are not effective means for reducing or solving the environmental pollution problem created by voluminous used containers.

An object of the present invention is to provide a container made of sturdy metal which can be easily collapsed into a flat shape to permit easy collection after use and thus solve the above-identified problem.

Another object of the present invention is to provide a container which may be smoothly collapsed. Still another object of the present invention is to provide a container which can be press-molded at a low cost.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BRIEF DESCRIPTION OF THE PREFERRED EMBODIMENTS

Figure 1:
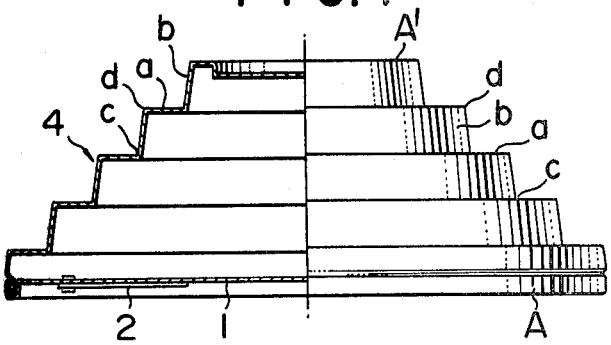
FIG. 1 is a frontal view, the left-half side of which is in section, of a preferred embodiment of the container according to the present invention.
Figure 2:
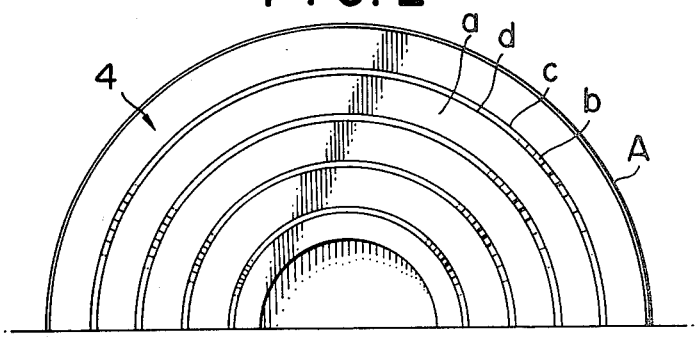
FIG. 2 is one-half of a plan view of the embodiment shown in FIG. 1.
Figure 3:
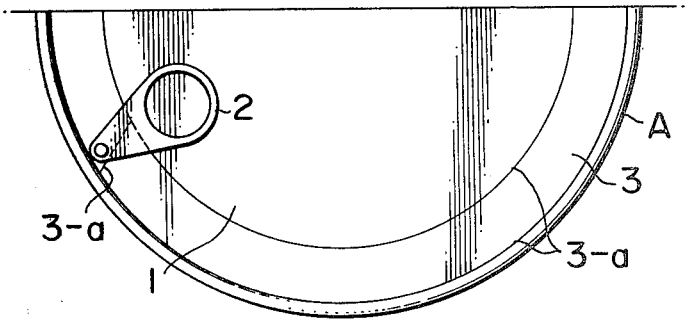
FIG. 3 is a one-half of a bottom view of the embodiment shown in FIG. 1.

In the drawings, reference A indicates a container, A′ is a container body, a is a substantially horizontal surface, b is a substantially vertical surface, c and d are connecting portions, and element 4 is a stepped wall consisting of said surfaces a and b and connection portions c and d.

In the drawings, a container A, constructed of e.g., aluminum, stainless steel or plastic material is formed into a cone shape, a pyramid shape, a frusto-conical shape or the like with its head portion being cut out. The circumferential margin 3 of the cover 1 can be cut along lines 3-*a* by an opener 2 provided therewith. The side wall 4 of the container body A′ is press-molded to be shaped stepwise (FIG. 1) or spirally.

Figure 6:
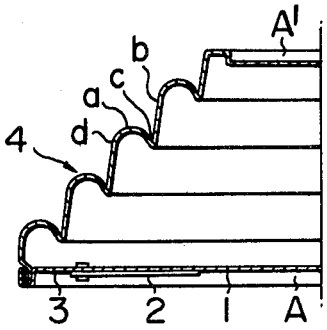

The stepped wall 4 of the container body A′ consists substantially of horizontal surfaces a and substantially vertical surfaces b connected with each other by connecting portions or connections c and d. The surfaces a may be horizontal as seen in FIG. 1 or semispherical as seen in FIG. 6. If desired, other forms as well can be taken with regard to the connecting portions. The surfaces b may be vertical or a bit curved as seen in FIG. 1. The width of the substantially horizontal surface a relative to the width of the vertical surface b may be optionally selected.

Figure 5:
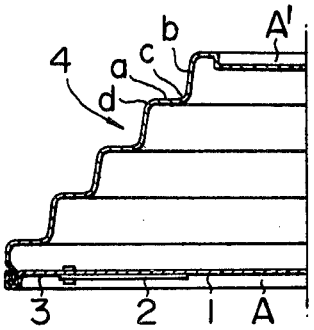
FIGS. 5 through 9 show frontal views of other embodiments of the present invention.
Figure 7:
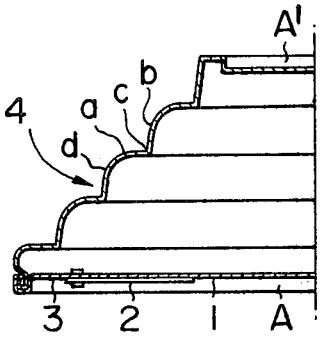
Figure 8:
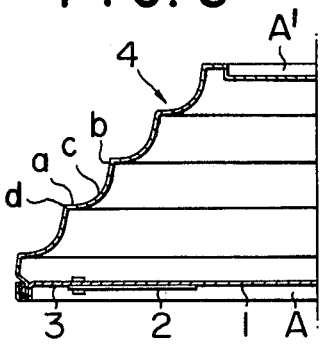

A connection c between the vertical and the horizontal surfaces b and a, and a connection d between the horizontal and the vertical surface a and b, may be formed angular in section (FIG. 1) or a bit curved (FIG. 5). Further, one connection c may be formed at a right-angled while the other D is curved as seen in FIG. 7. Moreover, one connection c may be reverse-circled while the other d is angled as seen in FIG. 8.

Figure 4:
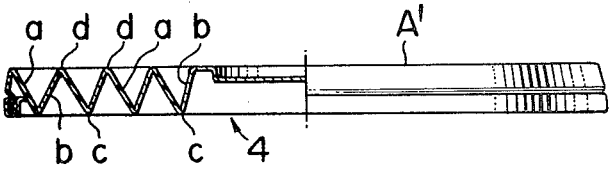
FIG. 4 is a frontal view, the left half of which is in section, of the collapsed container according to the present invention.
Figure 9:
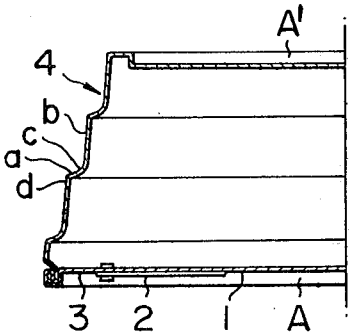
Figure 10:
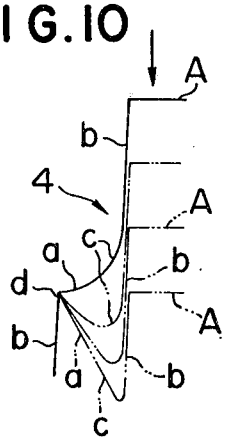
FIG. 10 is a view illustrating the collapsed state of the stepped portion of the embodiment shown in FIG. 9.

The connecting portions c and d in any embodiments form a V shape when the container is collapsed as seen in FIG. 4. When the width or the height of the vertical surface b is formed longer than that of the horizontal surface a, as seen in FIG. 9, the capacity of thus formed container is almost similar to that of the conventional container such as a cylindrical container, which cannot be collapsed by hand. Further, if the curvature of the connection c is made small, and if the horizontal surface a which follows the connection c is curved to a great extent, the capacity of the container is made greater. Since the connection c is circularly formed, the bended or folded portion, at the time when the container is collapsed, moves successively into the vertical surface as seen in FIG. 10, even with the pressure applied by a child's hands.

Thus, according to the present invention, the pressure applied on centers on the connections c, d and therefore, the horizontal and the vertical surfaces a, b are folded at these connections. Accordingly, the stepped wall 4 is collapsed from the cone shape as shown in FIG. 1 to a flat shape as shown in FIG. 4 such that the surfaces lie one on top of the other.

When the container body A′ is made of a flexible material and is not deformed, even if the container body A′ is crushed, the container can be used repeatedly.

Thus, in comparison with the conventional cylindrical-shaped container which cannot be collapsed by hand, the volume of the container of the present invention can be reduced by folding the horizontal and the vertical surfaces at the connecting portions one above the other, with only the pressure of a child's hands. Since the volume of the thus collapsed containers is about the same as the pressed volume of the container material, the used containers can be transported, for example, by only one vehicle or carrier compared to about ten carriers which would be required for transporting filled containers. Accordingly, since the containers can be reduced in volume without requiring special crushing machines, and since they can be efficiently recovered and collected with a significantly reduced number of carriers, as mentioned above, a pollution problem caused by the use of voluminous containers can be eliminated. Furthermore, the container having a stepped wall can be produced easily by a press-mold and, therefore, is relatively inexpensive.

Moreover, since the number of transportation vehicles or transportation medium, such as autotrucks, used for collecting and recovering the used containers is reduced, that is, since a plurality of autotrucks need not be used, exhaust gas pollution problems and a traffic jam problem is reduced as well as the fuel and personnel costs. Thus, various advantageous environmental and social effects are achieved by using the container according to the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A collapsible container made of metal comprising:

collapsible stepped walls which are formed by alternating substantially horizontal surfaces and substantially vertical surfaces, the width of said substantially horizontal surfaces of the stepped walls being smaller than that of said substantially vertical surfaces;

connecting portions between said substantially horizontal and said substantially vertical surfaces being alternately angled and curved;

whereby when the container is collapsed after being used with portions between said angled connecting portions and said curved connecting portions being bent, said curved connecting portions are moved successively into said vertical surfaces.

2. The collapsible container of claim 1, having a cone shape.

3. The collapsible container of claim 1, having a pyramid shape.

4. The collapsible container of claim 1, having a frusto-conical shape.

5. The collapsible container of claim 1, wherein the metal is aluminum or stainless steel.

6. A collapsible metal container comprising:

collapsible stepped walls of substantially the same thickness which are formed by alternating substantially horizontal surfaces and substantially vertical surfaces, the width of said substantially horizontal surfaces of the stepped walls being smaller than that of said substantially vertical surfaces;

connecting portions between said substantially horizontal and said substantially vertical surfaces being alternately angled and curved;

said container including a top and a spaced bottom, said top being adapted to mate with a cover for the container and said bottom being stepped inwardly from said top;

whereby when the container is collapsed after being used with portions between said angled connecting portions and said curved connecting portions being bent, said curved connecting portions are moved successively into said vertical surfaces to assume a V-shape in the fully collapsed position.

7. A collapsible container made of metal comprising:

collapsible stepped walls which are formed by alternating substantially horizontal surfaces and substantially vertical surfaces, the width of said substantially horizontal surfaces of the stepped walls being smaller than that of said substantially vertical surfaces;

connecting portions between said substantially horizontal and said substantially vertical surfaces being alternately angled and curved, said width of the substantially horizontal surface being extremely small and said substantially horizontal surface forming only a part of the curved connecting portion;

whereby when the container is collapsed with portions between said angled connecting portions and said curved connecting portions are bent, said curved connecting portions being moved successively into said vertical surfaces.

* * * * *